US009293863B2

(12) United States Patent
Dabov et al.

(10) Patent No.: US 9,293,863 B2
(45) Date of Patent: Mar. 22, 2016

(54) MOUNTABLE OPEN TOP CONNECTOR HAVING A RETAINER

(71) Applicant: APPLE INC., Cupertino, CA (US)

(72) Inventors: Teodor Dabov, San Francisco, CA (US); Douglas J. Weber, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 5 days.

(21) Appl. No.: 14/305,203

(22) Filed: Jun. 16, 2014

(65) Prior Publication Data

US 2015/0364867 A1 Dec. 17, 2015

(51) Int. Cl.
*H01R 13/62* (2006.01)
*H01R 13/639* (2006.01)
*H01R 43/26* (2006.01)

(52) U.S. Cl.
CPC ..... *H01R 13/639* (2013.01); *H01R 43/26* (2013.01); *Y10T 29/49119* (2015.01)

(58) Field of Classification Search
CPC ..... H01R 23/7005; H01R 23/7021; H01R 23/7068; H01R 13/20; H01R 31/193
USPC ..... 439/62, 296, 299, 325
See application file for complete search history.

(56) References Cited

U.S. PATENT DOCUMENTS 3,436,715 A * 4/1969 Matthews ..... H01R 12/81 439/329
5,975,946 A * 11/1999 Watanabe ..... H01R 13/193 439/557
6,231,364 B1 * 5/2001 Liu ..... H01R 12/83 361/801
7,112,102 B2 * 9/2006 Masaki ..... H01R 12/75 439/660
7,591,672 B2 * 9/2009 Wu ..... H01M 2/1038 439/500
7,654,829 B1 * 2/2010 Chuang ..... H01R 12/79 439/67
2011/0306229 A1 * 12/2011 Katsui ..... H01R 24/005 439/345

* cited by examiner

*Primary Examiner* — Vanessa Girardi
(74) *Attorney, Agent, or Firm* — Kilpatrick Townsend & Stockton LLP

(57) ABSTRACT

An article is disclosed. The article is an open connector that includes a base and first and second sides. The base and the first and second sides together define a receptacle channel. The receptacle channel is sized and shaped to receive a connector insert. The open connector includes one or several electrical contacts that can be located proximate to the base of the open connector. The electrical contact electrically connects with the connector insert. The open connector includes a retainer that can interact with a portion of the connector insert to retain the connector insert within the receptacle channel.

17 Claims, 4 Drawing Sheets

MOUNTABLE OPEN TOP CONNECTOR HAVING A RETAINER

FIELD

The described embodiments relate generally to connectors. More particularly, the present embodiments relate to board-level connectors that can be incorporated into an electronic device.

BACKGROUND

Mobile devices such as laptop and notebook computers, media players, smart phones, tablets, and others have become ubiquitous in the last few years and their popularity shows no sign of abating. Further, there is an increasing desire for compact and light-weight devices to thereby increase portability.

The size of many mobile devices, however, is limited by the size and design of hardware components used in these devices. In many instances, current hardware components are large and bulky and additionally require empty "buffer" zones located around themselves. These unused spaces unnecessarily increases the size of the mobile device.

SUMMARY

The connector system can include an open connector that can be, for example, a connector receptacle, and a connector insert. The open connector can have at least one electrical contact, a bottom, and first and second sides. The first and second sides and the bottom can define a receptacle channel. However, the open connector does not have a top located opposite the bottom. Thus, the receptacle channel is an open channel. The open connector can be connected to a mating surface, which can be a structural component of a mobile device. The mating surface can attach to the first and second sides of the open connector to be located opposite the bottom.

The connector system can include a retainer that can maintain contact between the electrical contacts and the connector insert. The retainer can be located on the connector insert, on the connector receptacle, or on the mating surface. The retainer can fix the position of the connector insert by forcing the connector insert into the mating surface and/or by engaging with a component of the connector insert. The retainer can be a mechanical feature, an adhesive, or the like.

One aspect of the present disclosure relates to a connector receptacle. The connector receptacle includes a body having a base, a first side located at a first end of the base, a second side located at a second end of the base, and an open top above the base and extending from the first side to the second side. In some embodiments, the first and second sides extend above the base of the body and in some embodiments, the first and second sides and the base of the body define a receptacle channel. The connector receptacle can include a plurality of electrical contacts located between the first and second sides and a retainer that prevents movement of a connector insert parallel to the base of the body and that does not prevent movement of the connector insert perpendicular to the base of the body.

In some embodiments, the connector receptacle includes an attachment feature that can secure the connector receptacle to a mounting surface. In some embodiments, the attachment feature can be an adhesive, a magnet, and/or a mechanical fastener. In some embodiments, the plurality of electrical contacts is linearly arranged.

In some embodiments of the connector receptacle, the retainer is a feature of at least one of the electrical contacts. In some embodiments, the retainer can be moved from a first position to a second position. In one such embodiment, a distance separating a portion of the retainer that interacts with the connector insert from the base of the body increases when the retainer is moved from the first position to the second position. In some embodiments, the retainer can apply a force to the connector insert in a direction perpendicular to and away from the base of the body.

One aspect of the present disclosure relates to a connector system. The connector system includes a mounting surface having a planar portion and a connector receptacle connected to the planar portion of the mounting surface. The connector receptacle includes a body having a base, a first side located at a first end of the base, a second side located at a second end of the base, and an open top above the base and extending from the first side to the second side. In some embodiments, the first and second sides extend above the base of the body to connect with the planar portion of the mounting surface. In some embodiments, the planar portion of the mounting surface extends above the base of the body such that the planar portion of the mounting surface, the base, and the first and second sides define a receptacle volume.

In some embodiments, the connector system includes a connector insert partially positioned within the receptacle volume. In some embodiments, the connector system includes a plurality of electrical contacts located between the first and second sides and a retainer that prevents movement of the connector insert parallel to the base of the body and that does not prevent movement of the connector insert perpendicular to the base of the body.

In some embodiments, the retainer can be moved from a first, open position to a second, closed position. In some embodiments, the retainer can compress the connector insert against the mounting surface when the connector insert is in the second, closed position. In some embodiments, the connector insert has a retention feature that interacts with the retainer to prevent movement of the connector insert.

One aspect of the present disclosure relates to a method of assembling an electronic device. The method includes attaching a connector receptacle to a mounting surface. In some embodiments, the connector receptacle includes a body having a base, a first side located at a first end of the base, a second side located at a second end of the base, and an open top above the base and extending from the first side to the second side. In some embodiments, the first and second sides extend above the base of the body to connect with the planar portion of the mounting surface. In some embodiments, the connector receptacle can be connected to the planar portion of the mounting surface such that the planar portion of the mounting surface, the base, and the first and second sides define a receptacle volume. The method can include inserting a portion of a connector insert into the receptacle volume and securing the portion of the connector insert in the receptacle volume.

In some embodiments of the method, the connector receptacle can include a plurality of electrical contacts positioned between the first and second sides. In some embodiments, the plurality of electrical contacts electrically connects with portions of the connector insert. In some embodiments, securing the portion of the connector insert in the receptacle volume can include forcing the portion of the connector insert against the mounting surface.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a connector system. The connector system can include an open connector that can be, for example, a connector receptacle, and a connector insert. The open connector can be a board-level connector that can be, for example, electrically connected to a circuit board. The open connector can have at least one electrical contact, a base located at a bottom surface of the open connector, and first and second sides. However, the open connector does not have a component located opposite the base. Thus, the first and second sides and the base together define an open receptacle channel. The open receptacle channel can receive a connector insert to electrically connect the connector insert to the circuit board.

The open connector can be connected to a mating surface, which can be a structural component of a mobile device. In one embodiment, the mating surface can be a portion of the housing of the electrical device. The mating surface can attach to a top surface of the first and second sides of the open connector. This attachment of the mating surface to the top surface of the first and second sides of the open connector can position the mating surface opposite the base of the open connector and can define an upper boundary of the open receptacle channel.

The connector system can include a retainer that can maintain contact between the electrical contacts and the connector insert. The retainer can be located on the connector insert, on the connector receptacle, or on the mating surface. The retainer can fix the position of the connector insert by forcing the connector insert into the mating surface and/or by engaging with a component of the connector insert. The retainer can be a mechanical feature, an adhesive, or the like.

These and other embodiments are discussed below with reference to FIGS. 1-7. However, those skilled in the art will readily appreciate that the detailed description given herein with respect to these Figures is for explanatory purposes only and should not be construed as limiting.

Figure 1:
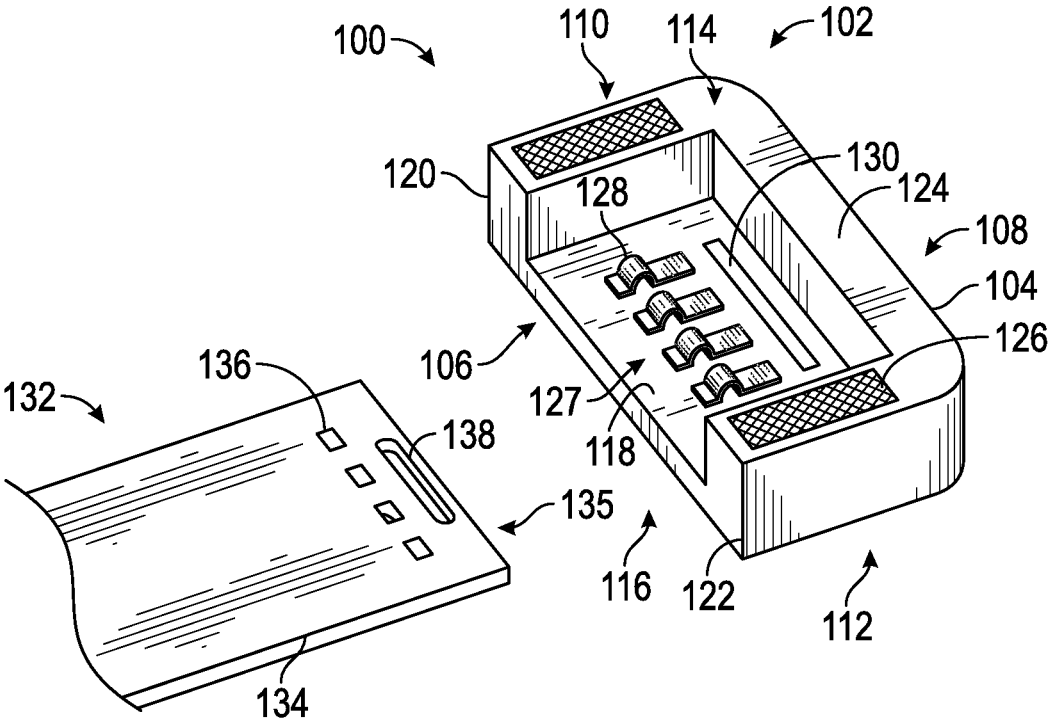
FIG. 1 shows a perspective view of one embodiment of a connector system.

FIG. 1 illustrates a perspective view of one embodiment of a connector system 100. Connector system 100 can connect components within an electric device such as, for example, within a mobile device. Connector system 100 can include a variety of components. As depicted in FIG. 1, connector system 100 includes an open connector 102. Open connector 102 can be a connector receptacle and can be sized and shaped to receive a connector insert. Open connector 102 can be made from a variety of materials and can include a number of components.

Open connector 102 can include a body 104. Body 104 of open connector 102 can provide the structure for receiving the connector insert, for attaching to a circuit board including, for example, a printed circuit board (PCB), a flexible circuit board (FCB), or the like, and/or for attaching to a mounting surface, which can include, for example, any surface of any component of the electronic device. Body 104 can be a variety of shapes and sizes. In the embodiment depicted in FIG. 1, body 104 has a front 106, a back 108, a first end 110, a second end 112, a top surface 114, and a surface bottom 116. Body 104 can be made from a variety of materials, and in some embodiments, body 104 can be made from an insulative material.

Body 104 can have a base 118 which can be located at bottom surface 116 of body 104. Base 118 of the body can be a planar or substantially planar member. Base 118 can, in some embodiments, be attached to a circuit board including, for example, a printed circuit board (PCB), a flexible circuit board (FCB), or the like.

As seen in FIG. 1, body 104 can include a first side 120 extending from base 118 of body 104. First side 120 can be located at and/or proximate to first end 110 of body 104. Body 104 can include a second side 122 extending from base 118 of body 104. Second side 122 can be located at and/or proximate to second end 112 of body 104.

In some embodiments, first and second sides 120, 122 can be connected by base 118 of the body and/or by a rear wall 124 of body 104. Rear wall 124 can extend from base 118 of body 104 and can be, in some embodiments, located at back 108 of body 104. In some embodiments, first and second sides 120, 122 and rear wall 124 can each have a height by which they extend above base 118 of body 104. In some embodiments, the heights of first and second sides 120, 122 and rear wall 124 are the same, and in some embodiments, the heights of first and second sides 120, 122 and rear wall 124 are different. In the embodiment depicted in FIG. 1, the heights of first and second sides 120, 122 and rear wall 124 are the same. In some embodiments, some or all of first and second sides 120, 122 and rear wall 124 extend to top surface 114 of body 104. When the heights of first and second sides 120, 122 and rear wall 124 are the same, each of first and second sides 120, 122 and rear wall 124 extend to top surface 114 of body 104.

Base 118, first and second sides 120, 122 and rear wall 124 of body 104 can together bound and/or define a receptacle channel 125. In some embodiments, receptacle channel 125 can be sized and shaped to receive the connector insert. As seen in FIG. 1, body 104 does not include a feature that is positioned above the receptacle channel 125 and/or above base 118 of body 104. Thus, receptacle channel 125 is open.

Body 104 can include one or several attachment features 126. Attachment features 126 can be used to attach open connector 102 to a circuit board including, for example, a PCB, a FCB, or the like and/or to the mounting surface. In some embodiments, attachment features 126 can be sized, shaped, and/or located to allow attachment at bottom surface 116 and/or top 114 of body 104. As depicted in FIG. 1, attachment features 126 can be located at top surface 114 of body 104, and can be specifically located at top surface 114 of first and second sides 120, 122 of body 104.

Attachment features 126 can be any feature capable of attaching body 104 and/or open connector 102 to the desired component of the electrical device. In some embodiments, attachment features 126 can be, for example, a mechanical fastener such as a screw, a weld, a snap, a heat stake, hook and loop fasteners, or the like. In some embodiments, attachment features 126 can be an adhesive such as glue, tape, or the like, and in some embodiments, attachment features 126 can be one or several magnets located in body 104 of open connector 102.

Open connector 102 can include one or several electrical contacts 128. Electrical contacts 128 can create an electrical connection with components of the connector insert. Electrical contacts 128 can be any desired size and shape and can be located in any desired position. In some embodiments, electrical contacts 128 are linearly located along bottom surface 116 of body 104. In some embodiments, electrical contacts 128 can be located in the receptacle channel 125, and in some embodiments, electrical contacts 128 can be linearly located so as to be parallel or non-parallel with one or both of front 106 and back 108 of the body. In some embodiments, electrical contacts 128 can be connected with components of the circuit board so as to conduct signals from the connector insert to the circuit board.

Connector system 100 can include a retainer 130. Retainer 130 can be one or several features that can retain the connector insert within the receptacle channel 125. Retainer 130 can, for example, be a component of open connector 102, as depicted in FIG. 1, and in some embodiments, retainer 130 can be located on the connector insert, the mounting surface, and/or the circuit board. In some embodiments, retainer 130 can be integral with another component of open connector 102 such as, for example, base 118, one or both of the first or second sides 120, 122, rear wall 124, and/or electrical contacts 128.

Connector system 100 can include connector insert 132. Connector insert 132 can connect with open connector 102 and can provide electric signals and receive electric signals via open connector 102. In some embodiments, connector insert 132 can be and/or include a connector body 134 that can be an elongate member that can include one or several conductive portions separated by one or several insulative portions. In some embodiments, connector body 134 can be an FCB. In some embodiments, and as seen in FIG. 1, connector body 134 can include an insertion end 135 that can be sized and shaped to be received within the receptacle channel.

Connector insert 132 can include one or several connector contacts 136. In some embodiments, connector contacts 136 can be sized, shaped, and located to electrically connect with one or several electrical contacts 128 of open connector 102. In some embodiments, connector contacts 136 can be located on insertion end 135 of connector body 134.

In some embodiments, connector insert 132 can include a retention feature 138. Retention feature 138 can be one or several features that can cooperate with retainer 130 to retain connector insert 132 within receptacle channel 125. Retention feature 138 can be, for example, a component of connector insert 132, as depicted in FIG. 1, and in some embodiments, retention feature 138 can be located on open connector 102, the mounting surface, and/or the circuit board. In some embodiments, the retention feature can comprise one or several holes, depressions, divots, or the like.

Figure 2:
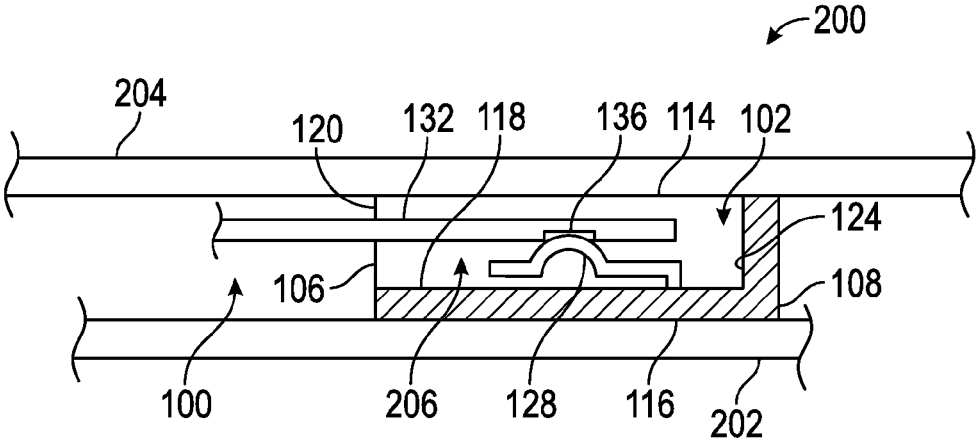
FIG. 2 shows a section view of one embodiment of the assembled system.

FIG. 2 illustrates a side section view of one embodiment of assembled connector system 200. In some embodiments, assembled connector system 200 can include open connector 102 and connector insert 132. As seen in FIG. 2, open connector 102 is positioned between circuit board 202 and mounting surface 204. Specifically, bottom surface 116 of open connector 102 is contacting circuit board 202, and in some embodiments, open connector 102 can be connected to circuit board 202. As further seen, top surface 114 of open connector 102 is contacting mounting service 204, and specifically, top surface 114 can be connected to mounting surface 204. In some embodiments, the position of circuit board 202 and mounting surface 204 can be switched such that circuit board 202 contacts top surface 114 of open connector 102 and mounting surface 204 contacts bottom surface 116 of open connector 102.

As further seen, the connection of mounting surface 204 to top surface 114 of open connector 102 covers the receptacle channel to form receptacle volume 206. Receptacle volume 206 is bounded, in FIG. 2, by front 106, base 118, and rear wall 124 of open connector 102 and mounting surface 204 connected to top surface 114 of open connector 102.

Connector insert 132 extends into receptacle volume 206. As seen in FIG. 2, connector contacts 136 of connector insert 132 connect with electrical contact 128 of open connector 102. In some embodiments, the connection of one or several of connector contacts 136 and one or several of electrical contacts 128 can establish an electrical connection between connector insert 132 and the circuit board 202.

Figure 3A:
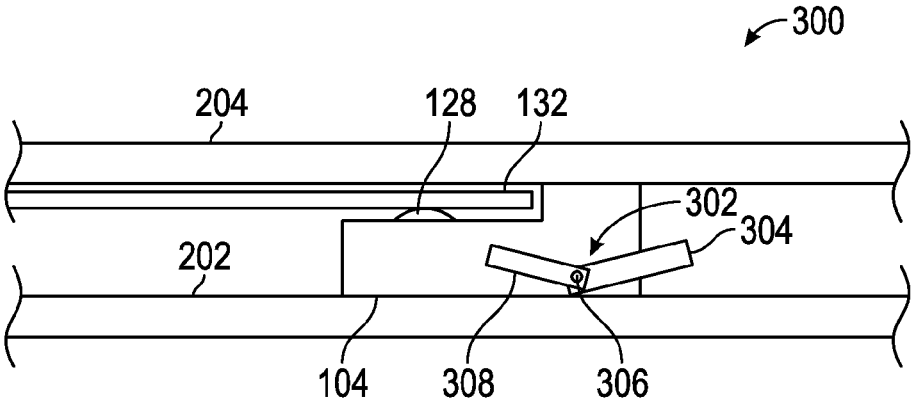
FIGS. 3A and 3B show a side view of one embodiment of a two-piece retainer for use with the connector system.
Figure 3B:
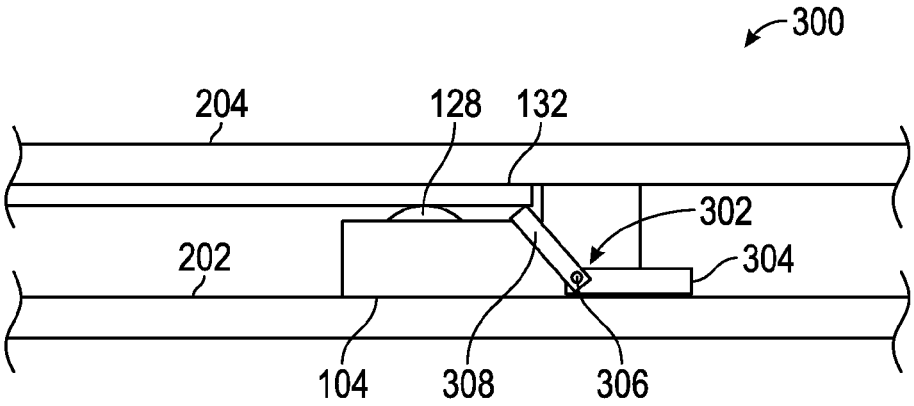

FIGS. 3A and 3B illustrate side views of one embodiment of an assembled system 300. As seen in FIG. 3A, assembled system 300 includes an open connector including body 104 and electrical contact 128. Body 104 of open connector 102 is positioned between circuit board 202 and mating surface 204, and specifically, is attached to circuit board 202 and mating surface 204. As depicted in FIG. 3A, connector insert 132 is inserted into receptacle volume 206. In FIG. 3A, connector insert 132 is not in contact with the electrical contact 128, and connector insert 132 is not retained within receptacle volume 206. In contrast, in FIG. 3B, connector insert 132 is in contact with electrical contact 128, and connector insert 132 is retained within receptacle volume 206.

FIGS. 3A and 3B further depict a two-position retainer 302. In the embodiments depicted in FIGS. 3A and 3B, two-position retainer 302 can be placed in a first, open position (shown in FIG. 3A) and can be placed in a second, closed position (shown in FIG. 3B). Two-position retainer 302 includes a control portion 304, a pivot 306, and a controlled portion 308. Two-position retainer 302 is constructed such that pivot 306 connects control portion 304 and controlled portion 308. In some embodiments, manipulation of control portion 304 can result in movement of controlled portion 308 from a first, open position to a second, closed position. In some embodiments, when controlled portion 308 moves from the first, open position to the second, closed position, the portion of controlled portion 308 that contacts and interacts with connector insert 132 moves from a position relatively more proximate to the base and bottom of the open connector to a position relatively more removed from the base and bottom of the open connector. In some embodiments, placement of two-position retainer 302 in the second position can retain connector insert 132 by forcing connector insert 132 into mating surface 204.

Figure 4:
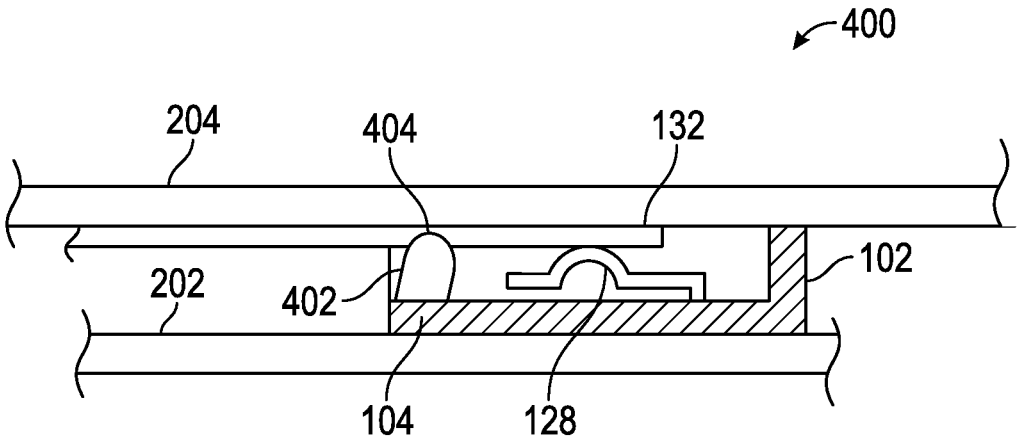
FIG. 4 shows a side view of one embodiment of a connector system including a retention protrusion.

FIG. 4 illustrates a side view of one embodiment of assembled system 400. Assembled system 400 includes open connector 102 including body 104 and electrical contacts 128. Open connector 102 is positioned between and connected to circuit board 202 and mounting surface 204. As seen in FIG. 4, connector insert 132 is inserted into receptacle volume of open connector 102 and is contacting electrical contacts 128. Connector insert 132 is retained within receptacle volume 206 by a combination of retention protrusion 402 extending from base 118 of body 104 and retention divot 404 in connector insert 132. As seen in FIG. 4, retention protrusion 402 and retention divot 404 are sized and shaped to interact with each other to retain connector insert 132. As further seen, retention protrusion 402 and retention divot 404 can be sized and shaped such that connector insert 132 is pressed against mating surface 204 by retention protrusion 402 to thereby retain connector insert 132 in receptacle volume 206.

Figure 5:
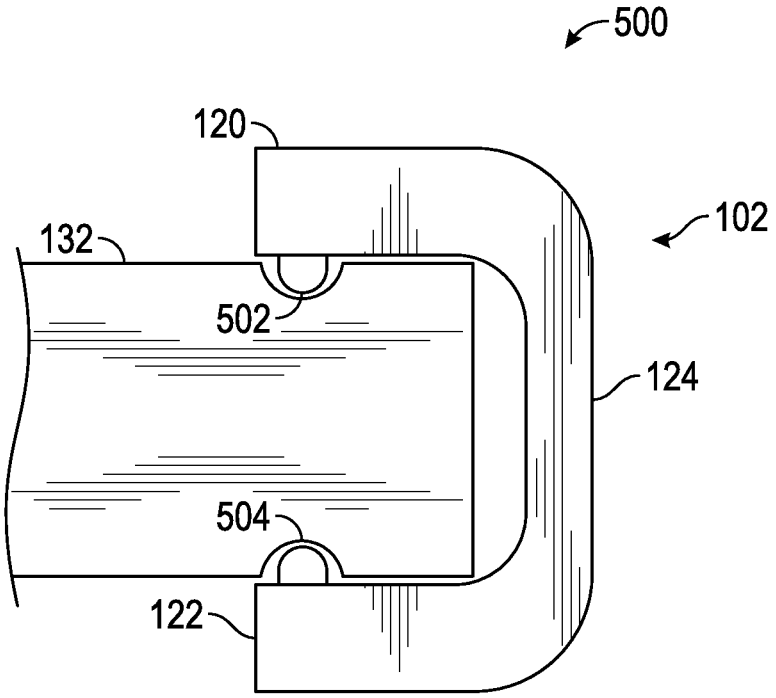
FIG. 5 shows a top view of one embodiment of a connector system including side retention protrusions.

FIG. 5 is a top view of one embodiment of assembled system 500. Assembled system 500 includes open connector 102 having first side 120, second set 122, and rear wall 124. In FIG. 5, first and second sides 120, 122 and rear wall 124 are connected in a U-shaped configuration. Assembled system 500 includes a pair of side retention protrusions 502, one of each extending from each of first and second sides 120, 122. Side retention protrusions 502 interact with retention divots 504 located on connector insert 132. In some embodiments, side retention protrusions 502 fit into retention divot 504 when connector insert 132 is inserted into the receptacle channel and/or receptacle volume.

Figure 6:
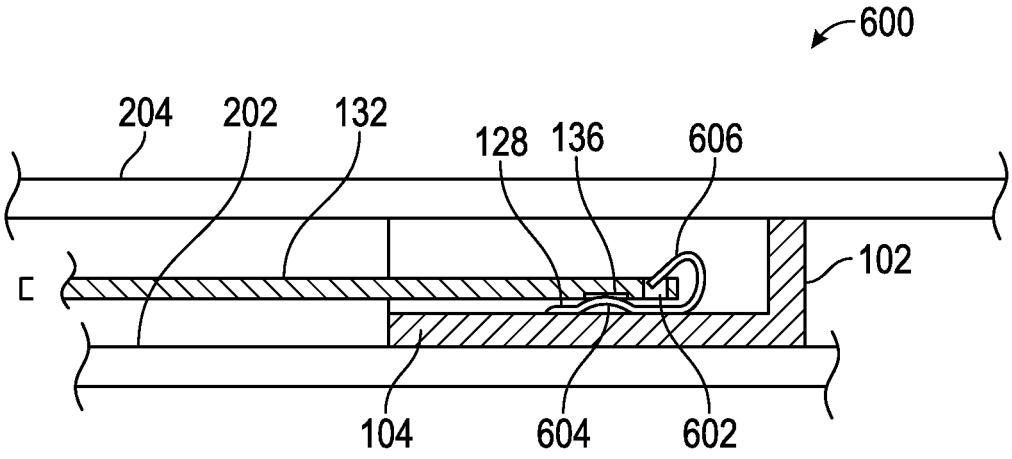
FIG. 6 shows a side view of one embodiment of a connector system with an electrical contact having a connector portion.

FIG. 6 is a side view of one embodiment of assembled system 600. Assembled system 600 includes open connector 102 positioned between, and attached to circuit board 202 and mating surface 204. Connector insert 132 is inserted into the receptacle volume 206 and positioned such that connector insert 132 touches electrical contact 128. Specifically, connector contact 136 is depicted as touching a contact portion 604 of the electrical contact 128. As further seen in FIG. 6, connector insert 132 includes hole 602 that is sized, shaped, and positioned to receive the retention portion 606 of electrical contact 128. Advantageously, such a design incorporates retainer 130 into electrical contact 128.

Figure 7:
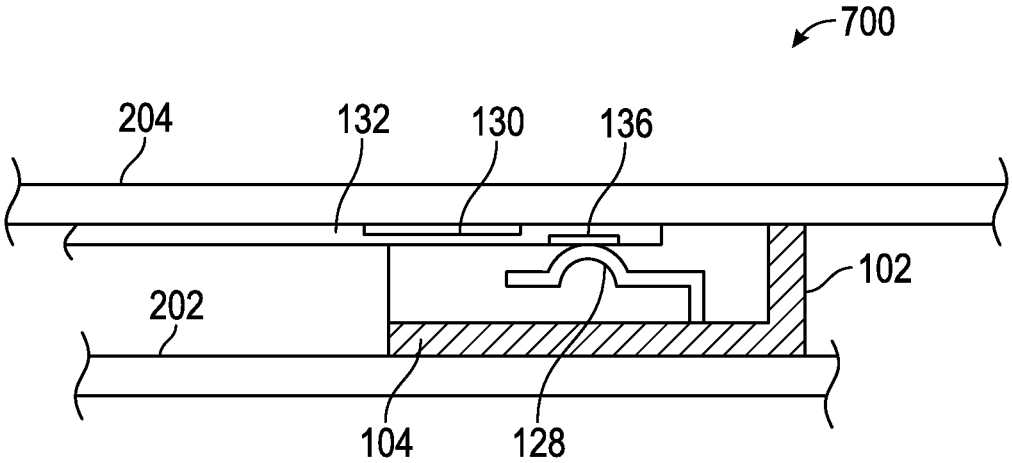
FIG. 7 shows a side view of one embodiment of a connector system having a retainer on a connector insert.

FIG. 7 is a side view of one embodiment of assembled system 700. Assembled system 700 includes open connector 102 positioned between, and attached to circuit board 202 and mating surface 204. Connector insert 132 is inserted into receptacle volume 206 and positioned such that connector insert 132 touches electrical contact 128. Specifically, connector contact 136 is depicted as touching the electrical contact 128. As further seen in FIG. 7, retainer 130 is located on connector insert 132. In some embodiments, retainer 130 can be an adhesive that can be, for example, adhered to mounting surface 204, to circuit board 202, and/or to a portion of open connector 102. In some embodiments, connector insert 132 can be adhered to the desired location after the insertion of connector insert 132 into the receptacle volume 206.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A connector receptacle, comprising:

a body having a base, a first side located at a first end of the base, a second side located at a second end of the base, and an open top above the base extending from the first side to the second side, wherein the first and second sides extend above the base of the body and with the base of the body define a receptacle channel;

a plurality of electrical contacts located between the first and second sides; and a retainer pivotally coupled to the body and configured to exert a force oriented away from the base for securing a connector insert between the first and second sides of the body.

2. The connector receptacle of claim 1, wherein the retainer is pivotally coupled to the body about an axis of rotation that extends through a portion of the body.

3. The connector receptacle of claim 1, wherein the plurality of electrical contacts are linearly arranged.

4. The connector receptacle of claim 1, wherein a central portion of the retainer is pivotally coupled to the body.

5. The connector receptacle of claim 1, further comprising an attachment feature configured to close the open top of the body by securing a portion of the connector receptacle to a mounting surface.

6. The connector receptacle of claim 5, wherein the attachment feature comprises an adhesive.

7. The connector receptacle of claim 5, wherein the attachment feature comprises a magnet.

8. The connector receptacle of claim 1, wherein the retainer is movable from a first position to a second position.

9. The connector receptacle of claim 8, wherein a distance separating a portion of the retainer that interacts with the connector insert from the base of the body increases when the retainer is moved from the first position to the second position.

10. A connector system, comprising:

a mounting surface; and a connector receptacle connected to a planar portion of the mounting surface, the connector receptacle comprising:

a body having a base, a first side located at a first end of the base, a second side located at a second end of the base, and an open top above the base extending from the first side to the second side, the first and second sides extending from the base of the body and connected to the planar portion of the mounting surface, wherein the planar portion of the mounting surface, the base and the first and second sides cooperate to define a receptacle volume, and a retainer coupled with the body and configured to compress a connector insert against the mounting surface.

11. The connector system of claim 10, comprising:

a plurality of electrical contacts located between the first and second sides, wherein the connector insert is electrically coupled to the electrical contacts when the retainer compresses the connector insert against the mounting surface.

12. The connector system of claim 11, wherein the retainer is pivotally coupled with the body.

13. A connector system, comprising:

a mounting surface having a planar portion; and a connector receptacle body, comprising:

a base having an interior-facing surface oriented towards the mounting surface, a first side extending from a first end of the base, a second side extending from a second end of the base, the first and second sides cooperating to form a flat surface oriented away from the interior surface of the base, the flat surface being coupled to the planar portion of the mounting surface and an open top above the base extending from the first side to the second side, wherein the planar portion of the mounting surface, the interior-facing surface of the base and the first and second sides cooperate to define a receptacle volume, and a retainer coupled to the connector receptacle body and configured to secure a connector insert within the receptacle volume.

14. The connector system of claim 13, wherein the retainer is pivotally coupled with the connector receptacle body.

15. The connector system of claim 14 comprising:

a plurality of electrical contacts located between the first and second sides.

16. The connector system of claim 15, wherein the retainer is movable from a first, open position to a second, closed position.

17. The connector system of claim 16, wherein the retainer is configured to compress the connector insert against the mounting surface when the connector insert is in the second, closed position.

* * * * *